United States Patent [19]

Machida

[11] 4,170,062

[45] Oct. 9, 1979

[54] EXTENSIBLE KNIFE WITH BLADE POSITION ADJUSTMENT

[75] Inventor: Naoyosi Machida, Seki, Japan

[73] Assignee: Kai Cutlery Center Co., Ltd., Gifu, Japan

[21] Appl. No.: 922,375

[22] Filed: Jul. 6, 1978

[51] Int. Cl.[2] ..... B26B 1/08; B26B 5/00

[52] U.S. Cl. ..... 30/162; 30/320

[58] Field of Search ..... 30/162, 320, 339, 2

[56] References Cited

U.S. PATENT DOCUMENTS

| | | | |
|---|---|---|---|
| 2,948,961 | 8/1960 | Ortner | 30/162 |
| 3,107,426 | 10/1963 | Robinson | 30/162 |
| 3,192,624 | 7/1965 | Gringer | 30/162 |
| 3,439,419 | 4/1969 | Fleming | 30/162 |
| 3,765,089 | 10/1973 | Ibata | 30/320 |
| 3,872,591 | 3/1975 | Quenot | 30/162 |
| 4,063,356 | 12/1977 | Hepworth | 30/320 X |
| 4,103,421 | 8/1978 | Quenot | 30/162 |

*Primary Examiner*—Jimmy C. Peters

*Attorney, Agent, or Firm*—Norbert P. Holler

[57] ABSTRACT

A knife comprises a knife handle or grip having a channel for receiving slidably therein a blade holder having a blade secured thereto so that the blade is withdrawn outwardly as it wears out. A series of notches are formed in the knife grip, while a V-like leaf spring is mounted on the blade holder, whereby the blade holder and hence the blade are held securely at predetermined indexed positions relative to the knife grip through engagement between the V-like leaf spring and the selected notch. A locking structure releasably locks the V-like spring member so that the latter is prevented from being accidently disengaged from the notch.

4 Claims, 8 Drawing Figures

EXTENSIBLE KNIFE WITH BLADE POSITION ADJUSTMENT

BACKGROUND OF THE INVENTION

1. Field of the Invention

The present invention relates to a knife composed of a knife handle or grip having a channel or C-like groove extending longitudinally thereof and a blade holder having a blade secured thereto and adapted to be slidably received in the channel so that the blade can be withdrawn or indexed bit by bit outwardly as the knife edge thereof wears out.

2. Description of the Prior Art

In the knife apparatus of the type described above, it has been hitherto known that a series of notches are formed in the knife handle or grip on one hand, while a V-like spring member is mounted on the blade holder on the other hand, whereby the slidable blade holder and hence the blade are securely held by the knife handle through the engagement between the V-like spring and the notch. When the blade holder is moved to dispense the blade outwardly, the V-like spring is yieldably deformed to disengage from the notch. Such hitherto known structure is however disadvantageous in that the blade cannot be securely held by the knife handle or grip at the indexed position since the locked or latched state of the blade holder is assured only by the resiliency on restoring force of the V-like spring member. Consequently, there may arise a danger of the blade tottering or rattling particularly in the applications where a relatively great cutting force is required. Of course, more positive locking of the blade holder as well as the blade to the knife handle may be attained by using a spring member having a correspondingly increased spring force. However, then the movement of the blade holder relative to the knife handle can not be effected smoothly.

SUMMARY OF THE INVENTION

An object of the invention is therefore to provide a knife apparatus incorporating an improved locking structure which allows the blade holder to be fixedly and positively secured at indexed positions relative to the knife handle, while permitting the blade holder and the blade to be smoothly moved to a new position.

In view of the above and other objects which will become apparent as description proceeds, there is provided according to a main feature of the invention, a knife apparatus which comprises an elongated handle member having longitudinal edge portions bent in opposition to each other so as to define a channel, one of the longitudinal edge portions being formed with a plurality of successive notches, a blade holder having a blade secured thereto and adapted to be slidably accommodated within the channel so that the blade is moved relative to the handle member, and locking means mounted on the blade holder and having a V-like leaf spring member an apex portion of which is adapted to selectively and releasably engage in one of the notches thereby to lock the blade holder to the handle, the locking means further including securing means for releasably securing the V-like spring member fixedly at the locking position so that the apex portion of the spring member be prevented from being disengaged from the selected notch.

BRIEF DESCRIPTION OF THE DRAWINGS

The above and other objects, features and advantages of the invention will become more apparent from the description taken in conjunction with the accompanying drawings, in which.

DETAILED DESCRIPTION OF THE PREFERRED EMBODIMENTS

Figure 1:
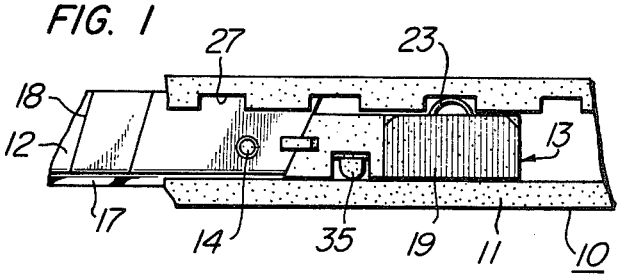
FIG. 1 is a top plan view showing a knife apparatus according to the invention with some portions being broken away.

Referring to FIG. 1, a knife apparatus generally denoted by reference numeral 10 includes a knife grip or handle 11 having a substantially C-like rectangular cross-section so as to define a channel into which a blade 12 mounted on a blade holder 13 is slidably inserted. The blade 12 is mounted on the holder 13 through suitable means such as a pin 14 received in an opening 15 formed in the blade 12 and a bifurcated member 16 formed integrally with the blade holder 13, as is shown clearly in FIGS. 2 and 3. The blade 12 is adapted to be withdrawn outwardly from the handle 11 bit by bit as the knife edge 17 thereof is exhausted or worn. To this end, the blade 12 is scored with lines 18 along which the worn knife edge portion can be broken off. With a view to facilitating the slidable movement of the knife blade 12 relative to the holder 11, a manipulating button 19 is provided on the blade holder 13 so as to be manipulated by a thumb of a hand gripping the knife handle 11, thereby projecting or retracting the knife blade 12 from or into the handle 11.

In order to hold fixedly and immovably the blade 12 relative to the handle 11 at the indexed position while permitting the slidable movement of the blade 12, there has been hitherto known locking means which is usually composed of a series of notches formed in a longitudinal edge of the channel-like knife grip or handle and a spring member which is secured fixedly to the blade holder and adapted to be releasably engaged in the selected one of the notches, thereby to lock the blade to the blade holder under the resiliency of the spring member. Upon sliding movement of the blade holder, the spring member is yieldably deformed to disengage from the notch. Such hitherto known locking means has been however disadvantageous in that the blade can not be securely held by the handle at the indexed position since the locked state is assured only by the resiliency or restoring force of the spring member. As a result, there may arise a danger of the blade tottering particularly when a relatively large cutting force is required. Of course, more positive locking may be accomplished by using a spring member having an increased spring force.

However, then the movement of the blade holder relative to the knife handle can not be effected smoothly.

With the present invention, it is contemplated to eliminate such disadvantages of the hitherto known locking means and to provide an improved locking structure which allows the blade to be fixedly and positively secured at the indexed positions relative to the knife grip or handle, while permitting the blade to be smoothly moved to a new position.

Figure 3:
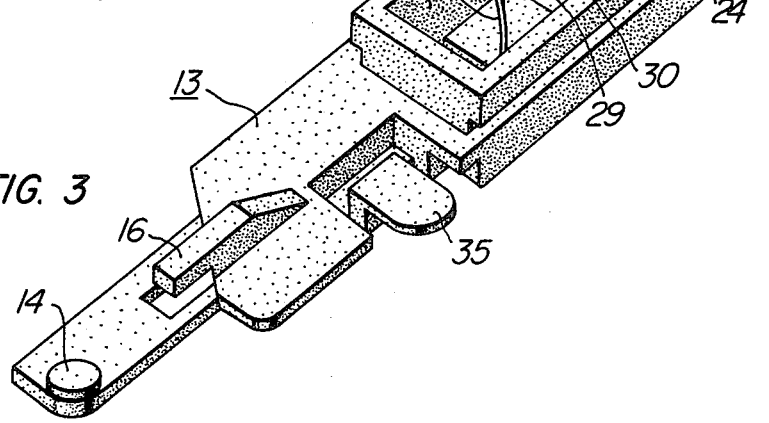
FIG. 3 is a similar view to FIG. 2 and shows a locking structure according to the invention with a manipulating button shown in FIG. 2 being removed.
Figure 4:
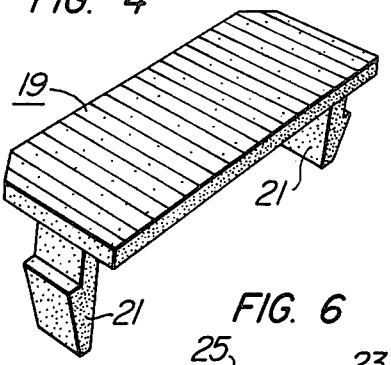
FIG. 4 is a perspective view of the manipulating button.

Now, the invention will be described in detail in conjunction with the preferred embodiment thereof shown in the drawings. Referring in particular to FIG. 3, a rectangular box 20 is provided on the blade holder 13 and has an open top side in which the manipulating button 19 shown in FIG. 4 is adapted to be disposed thereby to close the open top side of the box 20. To this end, the manipulating button 19 has a pair of claw-like depending legs 21 (FIG. 4), while the box 20 is formed with collars 22 (FIG. 3). When the button 19 is pressed downwardly into the box 20, the claw-like legs 21 will then engage with the respective latching collars 22 formed in the box 20, whereby the button 19 is prevented from being removed away from the box 20 while a vertical movement of the button 19 relative to the box 20 is allowed in a limited range, as will be described hereinafter.

A leaf spring member 23 of a substantially V-like form having two legs 24 is disposed within the box 20 with a rounded apex portion 25 extending outwardly freely through a window 26 formed in a side wall of the box 20 at the side facing to the channel edge of the handle 11 in which a series of rectangular notches 27 are formed (FIG. 1), so that the apex portion 25 of the V-like spring member 23 may extend into the selected one of the notches 27.

Figure 5:
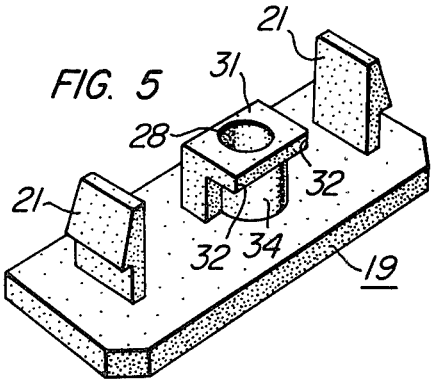
FIG. 5 shows the same in an upset state.
Figure 6:
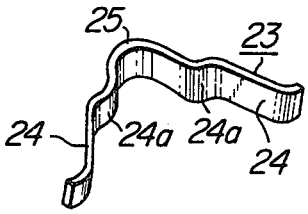
FIG. 6 is a perspective view showing a V-like leaf spring member employed in the locking structure according to the invention.

Referring to FIG. 5 which shows the manipulation button 19 in a perspective view as viewed from the bottom side, it will be noted that a cylindrical stud 34 is provided at the lower surface of the button 19 at a substantially mid portion thereof between the claw-like depending legs 21. The diameter or radius of the cylindrical stud 34 is selected to conform with the curvature of the rounded apex portion 25 of the V-like spring 23 and to be smaller than the curvature radius of the latter. A bore 28 is coaxially formed in the cylindrical stud 27 which serves to receive therein a compression coil spring 29 mounted around a pin 30 secured on the bottom of the box 20 (FIG. 3), when the button 19 is fitted into the box 20. It should be further noted that a rectangular press pad plate 31 is formed integrally with the cylindrical stud 27 at the free end thereof and has a pair of corner portions 32 projecting beyond the peripheral surface of the cylindrical stud 34. The dimension or width of the press pad plate 31 between the corner portions 32 is so selected that the corner portions 32 will bear against the intermediate curved portions **24*a* (FIG. 6) of the legs 24 of the leaf spring member 23 at the inner surfaces thereof, when the apex portion 25 of the spring 23 projects into the selected notch 27 through the window 26 at the indexed and locked position of the blade holder 13 and hence the blade 12 relative to the handle or grip 11**.

Figure 2:
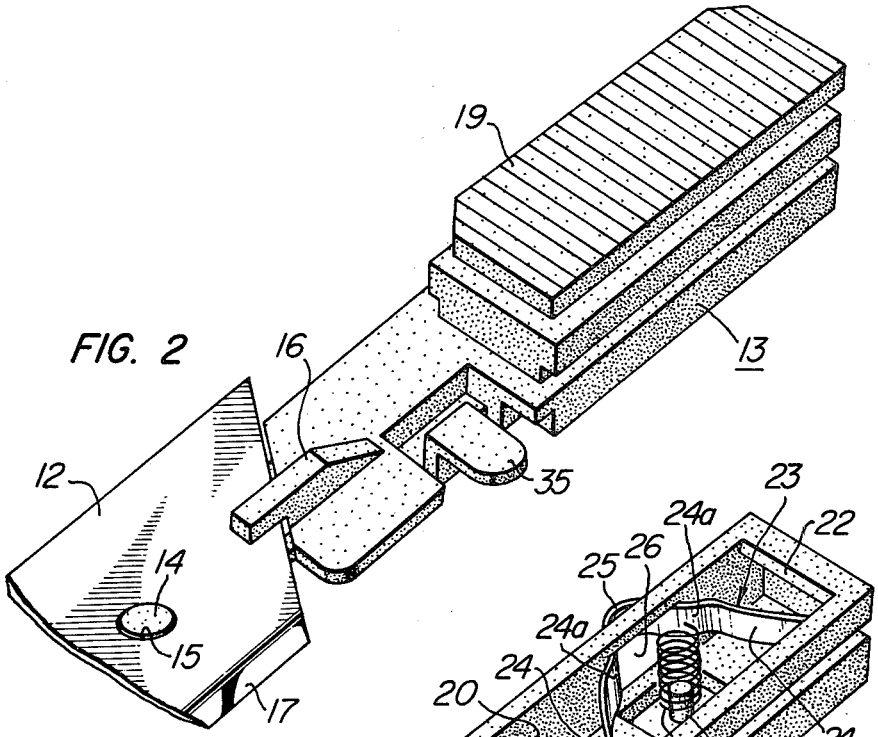
FIG. 2 is a perspective view showing a blade holder.
Figure 7:
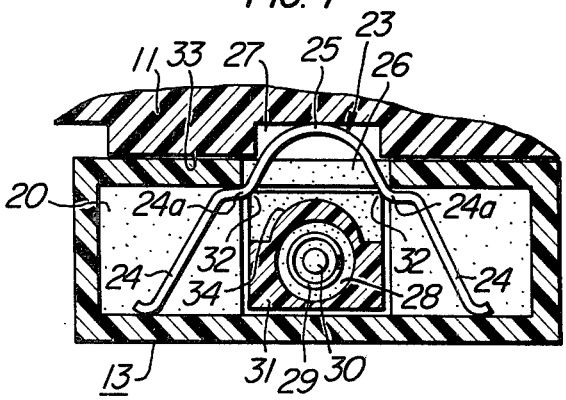
FIG. 7 is a sectional view to illustrate the locked positions of various components constituting the locking structure according to the invention.

As described hereinbefore, the manipulation button 19 is movable in the box 20 vertically as viewed in FIGS. 2 and 4 in a range delimitted by the engagement between the claws 21 formed in the button 19 and the collars 22 formed in the box 20. Under the influence of the coil spring 29 mounted around the post 30 and received in the bore 28 of the stud 34, the button 19 is usually resiliently urged to the uppermost or upper limit position in which the apex portion 25 of the V-like leaf spring 23 can extend through the window 26 to engage in one of the notches 27 thereby to lock the blade holder 13 and hence the blade 12 at the correspondingly indexed position. In this connection, it is important to note that the corner portions 32 of the rectangular press pad plate 31 bear against the intermediate curved or bent leg portions **24*a* of the V-like leaf spring 23 at the locked position, as can be best seen from FIG. 7, whereby deformation of the V-like leaf spring 23 at the apex portion 25 thereof is prevented due to the locking engagement between the latching corner portions 32 of the rectangular press pad plate 31 and the intermediate curved leg portions 24*a* of the V-like leaf spring 24. In this manner, the blade holder 13 with the blade 12** can be securely held at the indexed and locked position and will not be moved or rattled by external force such as cutting force.

Figure 8:
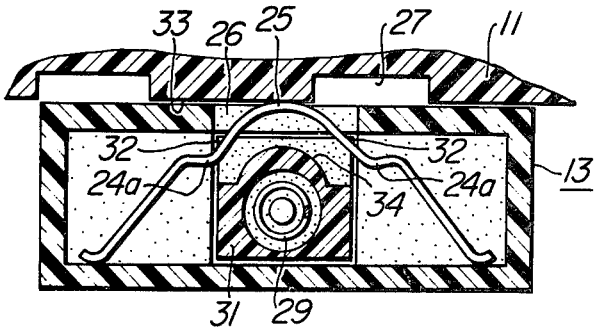
FIG. 8 is a similar view to FIG. 7 and shows the unlocked state.

In order to allow the blade holder 13 together with the blade 12 to be withdrawn or projected outwardly from the knife handle or grip 11 for the reason that the exposed edge 17 has been worn for example, the button 19 is pressed downwardly against the compression coil spring 29 thereby to disengage the corner portions 32 of the press pad plate 31 from the intermediate leg portions **24*a* of the V-like leaf spring 24. In this state, the leaf spring 24 can be easily resiliently deformed due to the fact that the radius of the cylindrical stud 34 around which the rounded apex portion 25 of the V-like leaf spring 23 is now positioned is selected smaller than the curvature radius of the spring apex portion 25, as is shown in FIG. 8. Thus, the blade holder 13 as well as the blade 12 can be slidably moved relative to the knife grip 11 with the V-like leaf spring 24 being yieldably expanded by the edge 33 of the grip 11, while the button 19 is maintained at the pressed position. When the position of a succeeding notch 17 has been attained, the apex portion 25 can project into the succeeding notch 27 due to the restoring spring force thereof. If the button 19 is released at this position, the corner portions 32 of the rectangular press pad plate 31 will again bear against the intermediate bent leg portions 24*a* of the V-like spring 24, whereby the blade holder 13 with the blade 12 can be securely locked at this new indexed position. It will of course be understood that the dimension of the window 26 through which the spring apex portion 25 extends is so selected that the locking of the blade holder 13 described above can be accomplisehd in cooperation with the V-like leaf spring 24 and the press pad plate 31**.

Reference numeral 35 denotes a tongue member which is formed integrally with the blade holder 13 and adapted to slidably engage with a longitudinal edge of the knife grip 11 disposed in opposition to the edge 33 formed with the notch 27 thereby to guide the movement of the blade holder 13 so that the edge 17 may not be injured due to a rough contact with the knife grip 11 under the force exerted by the deformed V-like leaf spring 24 upon the movement of the blade holder 13.

I claim:

1. A knife apparatus comprising an elongated handle member having longitudinal edge portions bent in opposition to each other so as to define a channel, one of said longitudinal edge portions being formed with a plurality of successive notches, a blade holder having a blade secured thereto and adapted to be slidably accommodated within said channel so that said blade is moved relative to said handle member, and locking means mounted on said blade holder and having a V-like leaf spring member an apex portion of which is adapted to selectively and releasably engage in one of said notches thereby to lock said blade holder to said handle, wherein said locking means further includes securing means for releasably securing said V-like spring member fixedly at said locking position so that said apex portion of said spring member be prevented from being disengaged from said selected notch.

2. A knife apparatus according to claim 1, further including a manipulating button for manipulating the movement of said blade holder relative to said knife handle, wherein said securing means is combined with said manipulating button in such a manner that said securing means is released from said securing position by moving said manipulating button in a direction perpendicular to the direction in which said blade holder is moved relative to said knife handle, whereby said apex portion of said V-like spring member can be disengaged from said notch through resilient deformation of said spring member.

3. A knife apparatus according to claim 1, wherein said locking means further includes (a) a box-like housing formed on said blade holder and adapted to accommodate therein said V-like spring member, said box-like housing having a side wall facing to said longitudinal edge of said handle with said notches, wherein said side wall is formed with a window through which said apex portion of said V-like spring member can extend outwardly to engage in selected one of said notches; (b) a manipulating button disposed on said box-like housing movably in a predetermined range in the direction perpendicular to the direction of the relative movement between said blade holder and said knife handle; (c) a coil spring means disposed within said box-like housing and adapted to urge said manipulating button toward a limit position;

wherein said securing means includes a press pad plate formed integrally with said manipulating button and adapted to press securely said V-like spring member onto said side wall defining said window at said limit position of said manipulating button, thereby to prevent said apex portion of said V-like spring member from being disengaged from said selected notch, while said press pad plate is adapted to disengage from said V-like spring member when said manipulating button is moved against spring force of said coil spring, thereby to allow said apex portion of said V-like spring to be disengaged from said selected notch and thus said blade holder to be moved relative to said knife handle.

4. A knife apparatus according to claim 1, further including guide means provided on said blade holder and adapted to engage the longitudinal edge of said handle located in opposition to the edge which is formed with said notches, thereby to guide the movement of said blade holder relative to said handle so that cutting edge of said blade is protected from injury during said relative movement.

* * * * *

UNITED STATES PATENT AND TRADEMARK OFFICE

CERTIFICATE OF CORRECTION

PATENT NO. : 4,170,062

DATED : October 9, 1979

INVENTOR(S) : NAOYOSI MACHIDA

It is certified that error appears in the above-identified patent and that said Letters Patent are hereby corrected as shown below:

Column 5, line 29, for "said handle with" read --said handle formed with--.

Signed and Sealed this

*Eleventh* Day of *March 1980*

[SEAL]

*Attest:*

SIDNEY A. DIAMOND

*Attesting Officer*

*Commissioner of Patents and Trademarks*